United States Patent [19]

Chao-Yang

[11] Patent Number: 4,754,512

[45] Date of Patent: Jul. 5, 1988

[54] TOY CONVERTIBLE TO BEDDING

[76] Inventor: Chen Chao-Yang, 5th Fl., 900, Min Sheng E. Rd., Taipei, Taiwan

[21] Appl. No.: 906,119

[22] Filed: Sep. 10, 1986

[51] Int. Cl.[4] ..... A47G 9/04; A63H 3/06

[52] U.S. Cl. ..... 5/482; 5/419; 5/485; 446/73; 446/226

[58] Field of Search ..... 5/419, 434, 442, 462, 5/482, 485, 437, 413; 446/72, 73, 74, 71, 226

[56] References Cited

U.S. PATENT DOCUMENTS

| | | | |
|---|---|---|---|
| 1,575,263 | 3/1926 | Guglielmi | 446/72 |
| 2,183,418 | 12/1939 | Williams | 5/437 X |
| 3,082,437 | 3/1963 | Upthagrove | 446/72 X |
| 3,689,947 | 9/1972 | Wolf | 5/419 |
| 4,154,323 | 5/1979 | Sneider | 5/417 X |
| 4,316,287 | 2/1982 | Rule | 5/413 X |
| 4,375,111 | 3/1983 | Hall | 5/420 X |
| 4,458,372 | 7/1984 | Mills | 5/413 |
| 4,543,669 | 10/1985 | Katz | 446/73 X |
| 4,575,876 | 3/1986 | Weaver | 5/413 X |
| 4,590,633 | 5/1986 | Pickens | 5/485 X |

FOREIGN PATENT DOCUMENTS

| | | | |
|---|---|---|---|
| 2061712 | 5/1981 | United Kingdom | 5/420 |

*Primary Examiner*—Alexander Grosz

*Attorney, Agent, or Firm*—Lowe, Price, LeBlanc Becker & Shur

[57] ABSTRACT

A toy in the shape of an animal has an opening to a cavity that contains an inflatable air cell, and a blanket that is adapted to be rolled and out of the cavity. The blanket is releasably connected to the toy.

1 Claim, 5 Drawing Sheets

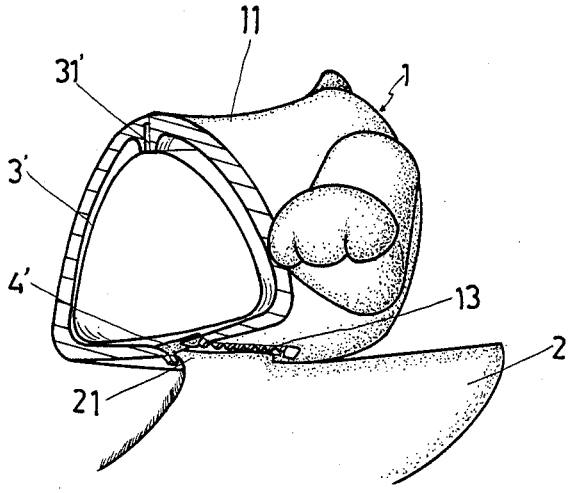
Fig.3
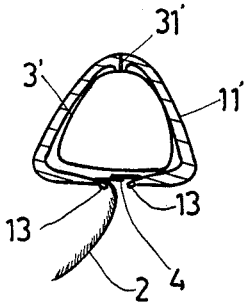
Fig.3a
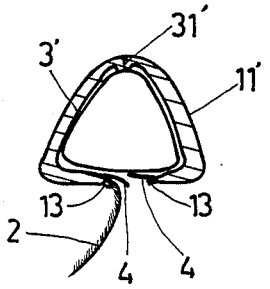
Fig 3-b

TOY CONVERTIBLE TO BEDDING

BACKGROUND OF THE INVENTION

The present invention relates to a convertible stuffed toy, particularly one comprising a blanket and an air cell to convert it to a bedding.

The main objective of the present invention is to provide a toy which is convertible to bedding. It is a novel structure which would become a favorite of children.

It is a convenient and practical bedding as well as a toy.

SUMMARY OF THE INVENTION

A toy convertible to a bedding comprising a toy body, a blanket, an air cell and a connection means. The toy body has an opening in the bottom and the blanket and air cell are contained in the toy body to form a stuffed toy. A side of the blanket is connected to a skin element of the toy body. The blanket can be removed out of the toy body for using as a normal blanket, and replaced by an inflated air cell so that the toy body can be used as a pillow. It is a toy at one time and it can be converted to a bedding at any time, and it would become a favorite of children.

BRIEF DESCRIPTION OF THE DRAWINGS

FIG. 3 is a partial sectional view illustrating connection between an end of the air cell and a side of the skin element of the toy body according to the present invention.

FIG. 3-*a* is a side view of that in FIG. 3.

FIG. 3-*b* is another side view which is different with the FIG. 3-*b* only in that the connection means is not closed.

DESCRIPTION OF THE PREFERRED EMBODIMENTS

Figure 1:
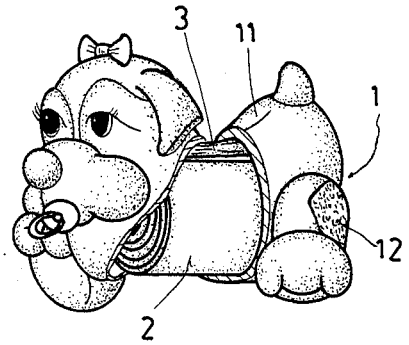
FIG. 1 is a partial sectional view of a preferred embodiment according to the present invention.

Please refer to FIG. 1 for a preferred embodiment according to the present invention. It is a stuffed toy in the shape of a dog mainly comprising a toy body (1), a blanket (2), an air cell (3) and a connection means (4) (Please refer to FIG. 3-*a* and FIG. 3-*b*). The toy body (1) is mainly composed of a skin element (11) and stuffing (12), with an opening (14) (Please refer to FIG. 2) in the bottom closed by means of a zipper (13). The opening (14) is for putting the blanket (2) and deflated air cell (3) into the body (1) to form a stuffed toy.

Figure 2:
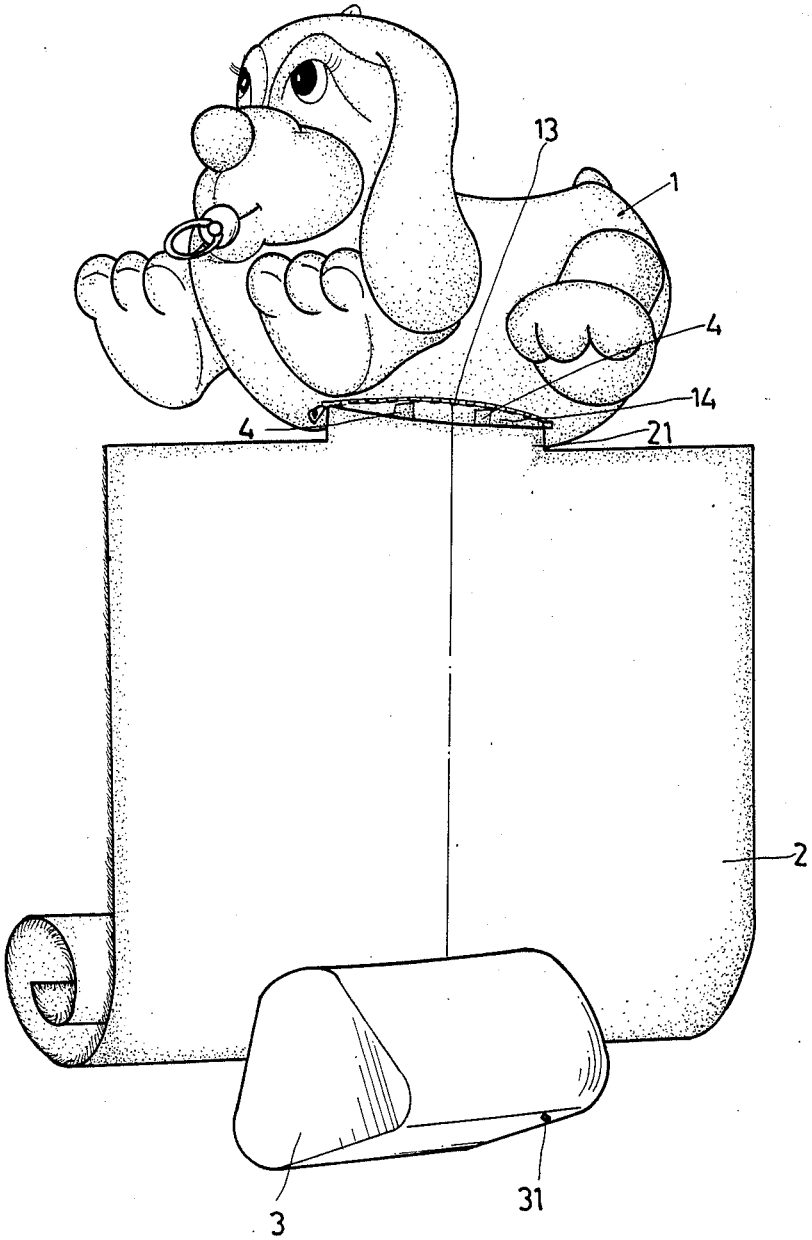
FIG. 2 is a fragmental view of the preferred embodiment in FIG. 1 from the bottom after removing the blanket.

Please refer to FIG. 2, the blanket (2) according to the present invention is a rectangle with a size which is sufficient for an ordinary child. A side (21) of the blanket (2) is connecting to an inner side of the skin element (11) at a position near the zipper (13) to ease removal from the opening (14). The air cell (3) according to the present invention is an independent unit which can be used along for other purpose, and can be removed from the present invention for inflation through an air valve (31) and then put into the body (1) to replace the blanket (2) so that the body (1) is kept inflated for using as a pillow.

Please refer to FIG. 3, the air cell (3') has a side (31') extending to the skin element (11) and fixed thereto to prevent from loss of the air cell (3'). Regardless of the type of air cell (3) or (3') used, a connection means (4) is used to close the opening (14) for closing the body (1) after removal of the blanket (2).

Please refer to FIGS. 3-*a* and 3-*b*, the connection means (4) is located beside the zipper (13) and along the inner side of the seam connecting the blanket (2) and the body (1) in order to close the opening (14) after removal of the blanket (2). In the preferred embodiment, self-adhesive tape or fasteners or other means of connection is used.

Figure 4:
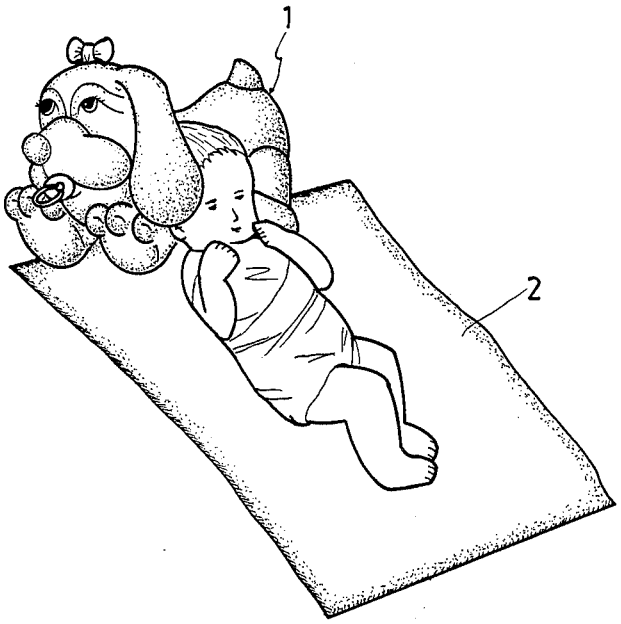
FIG. 4 illustrates the first application of a bedding converted from the present invention.

Please refer to FIG. 4 for a bedding converted from the toy, on which a child is lying. The body (1) is used as a pillow and the blanket (2) can be laid on the floor or bed as a bedding.

Figure 5:
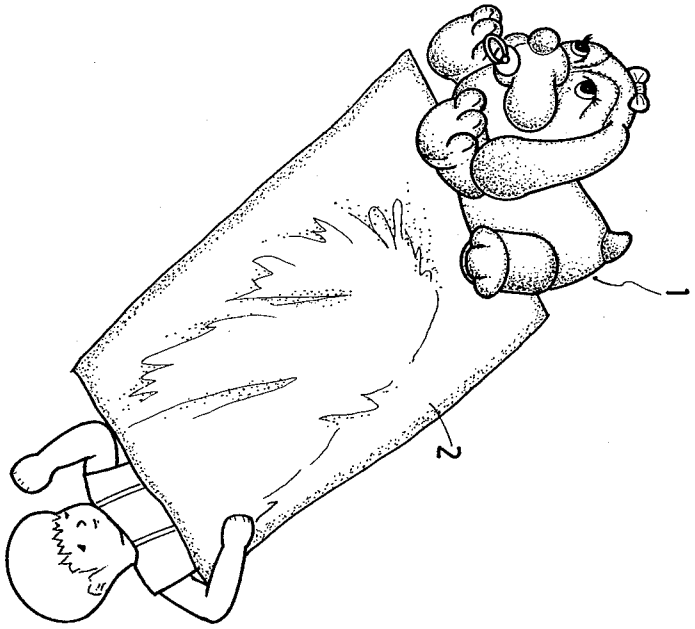
FIG. 5 illustrates the second application of a bedding converted from the present invention.

FIG. 5 illustrates another way to use the present invention. The blanket (2) is used as a normal blanket to cover one's body and the body (1) is placed behind the feet to prevent from kicking out the blanket.

The body (1) according to the present invention can be in the form of any toy, such as animal, doll, but in a shape that is suitable for use as a pillow for the expected effect.

Near, the conjunction of side (21) of blanket (2) and toy body(1), a zipper, is located so that the blanket (2) can be replaced for washing.

I claim:

1. A toy which is convertible to a bedding comprising:

a toy animal body, composed of a skin element with a hollow abdominal central portion and stuffed head end, rear end and appendages, said body having an opening in the bottom thereof opening into the central portion and a zipper closure across the opening;

a rectangular blanket of a size suitable for a child, adapted to be rolled into a cylindrical configuration and placed in the central portion of said toy body, removable through the said opening;

an inflatable air cell, disposed in the central portion of said toy body, said air cell having a side extending to, and being attached to the skin element to prevent its separation or loss from the toy body, said cell when inflated having a shape designed to fill the central portion and thereby form an abdomen;

connection means, located at the inner side of the said zipper, for closing the said opening after removal of the blanket and inflation of the air cell and for releasably connecting a side of the blanket to the skin element;

whereby the blanket in a rolled configuration and the deflated air cell may be stored in the toy body to form a normal toy, and may be used as a pillow, or the blanket can be used as a bedding or blanket after removing the blanket from the said toy body and inflation of the air cell.

* * * * *